US007011052B2

(12) United States Patent
Dow

(10) Patent No.: US 7,011,052 B2
(45) Date of Patent: Mar. 14, 2006

(54) VARIABLE CRANKSHAFT

(76) Inventor: Glendal R. Dow, 1320 Hardisty, Bedford, TX (US) 76021

( * ) Notice: Subject to any disclaimer, the term of this patent is extended or adjusted under 35 U.S.C. 154(b) by 0 days.

(21) Appl. No.: 11/008,888

(22) Filed: Dec. 10, 2004

(65) Prior Publication Data

US 2005/0126518 A1 Jun. 16, 2005

Related U.S. Application Data

(60) Provisional application No. 60/528,692, filed on Dec. 11, 2003.

(51) Int. Cl.
*F02B 75/04* (2006.01)

(52) U.S. Cl. ..... 123/48 B; 123/78 F

(58) Field of Classification Search ..... 123/48 B, 123/78 F; 74/600, 602
See application file for complete search history.

(56) References Cited

U.S. PATENT DOCUMENTS 1,553,009 A * 9/1925 Stuke ..... 74/602
4,860,702 A 8/1989 Doundoulakis
5,908,014 A 6/1999 Leithinger
6,349,684 B1 2/2002 De Gooijer
6,408,814 B1 * 6/2002 Shigemori ..... 123/197.4
6,564,762 B1 5/2003 Dow

* cited by examiner

*Primary Examiner*—Noah P. Kamen
(74) *Attorney, Agent, or Firm*—Bracewell & Giuliani LLP

(57) ABSTRACT

An adjustable crank shaft for a pump or engine allows the stroke of the piston to be varied. The piston rod has a circular bushing that engages an outer diameter portion of an outer crank member. The outer crank member has an inner diameter portion with a circular crank surface that is eccentric to the outer diameter portion of the outer crank member. An inner crank member has an outer diameter portion in sliding engagement with the crank surface of the outer crank member. The inner crank member is rotatable about a main drive axis that is eccentric relative to the outer diameter portion of the inner crank member. The outer crank member has a set of gear teeth on an inner diameter portion that are eccentrically offset from the crank bushing surface. An adjustment gear is in engagement with the gear teeth and mounted on a gear shaft that is coaxial with the main drive axis. The outer crank member revolves about the adjustment gear as the piston strokes and the adjustment gear is stationary. Selectively rotating the adjustment gear cause the outer crank member to rotate to a different position relative to the inner crank member and changes the stroke of the piston.

19 Claims, 5 Drawing Sheets

VARIABLE CRANKSHAFT

CROSS REFERENCE TO RELATED APPLICATION

This application claims priority to provisional application Ser. No. 60/528,692 filed Dec. 11, 2003.

FIELD OF THE INVENTION

This invention relates in general to crankshafts for engines or pumps and particularly to a crankshafts that provides an adjustable stroke.

BACKGROUND OF THE INVENTION

Internal combustion engines and reciprocating pumps have a piston that reciprocates in a cylinder. The piston has a rod that engages a crankshaft. The crankshaft is offset from the main drive axis to translate the linear motion of the piston and rotation of the shaft. Typically, the length of the stroke is fixed for a given crankshaft.

Changing the length of the stroke will change the compression ratio of an engine, but this normally requires replacing the crankshaft. Driving conditions may make it more efficient to have a higher compression ratio under certain conditions and a lower compression ratio under other conditions. It also might be advantageous to have a different stroke length for an exhaust stroke than for a compression stroke.

There are various proposals shown in patents that propose varying the piston stroke lengths. For various reasons, crankshaft assemblies of this nature are not commercially used at this time.

SUMMARY OF THE INVENTION

The drive apparatus of this invention includes a piston slidably carried in a cylinder for stroking reciprocally in the cylinder. A piston rod has a first end connected to the piston and a second end with a circular bushing. An outer crank member has a circular bushing portion that slidably engages the bushing. The outer crank member also has a circular set of gear teeth that are eccentric relative to the circular bushing portion. An inner crank member is in rotatable engagement with the outer crank member. The inner crank member is eccentric to the circular bushing portion and eccentric to and rotatable about a main drive axis.

An adjustment gear is in engagement with the gear teeth of the outer crank member so that the outer crank member revolves about the adjustment gear while the adjustment gear is stationary. The adjustment gear is selectively rotatable to cause the outer crank member to rotate to a different position relative to the inner crank member, thereby varying the stroke of the piston.

Preferably, the gear tooth ratio of the outer crank member teeth to the adjustment gear is at least two to one. Consequently, the piston makes at least two downward and two upward strokes for one revolution of the outer crank member while the inner crank member rotates only once. The position of the adjustment gear can result in the two downward strokes differing from each other and the two upward strokes equal, or vice versa. The positions can be varied to provide different stroke lengths for all four strokes of a four stroke cycle.

DETAILED DESCRIPTION OF THE INVENTION

Figure 1:
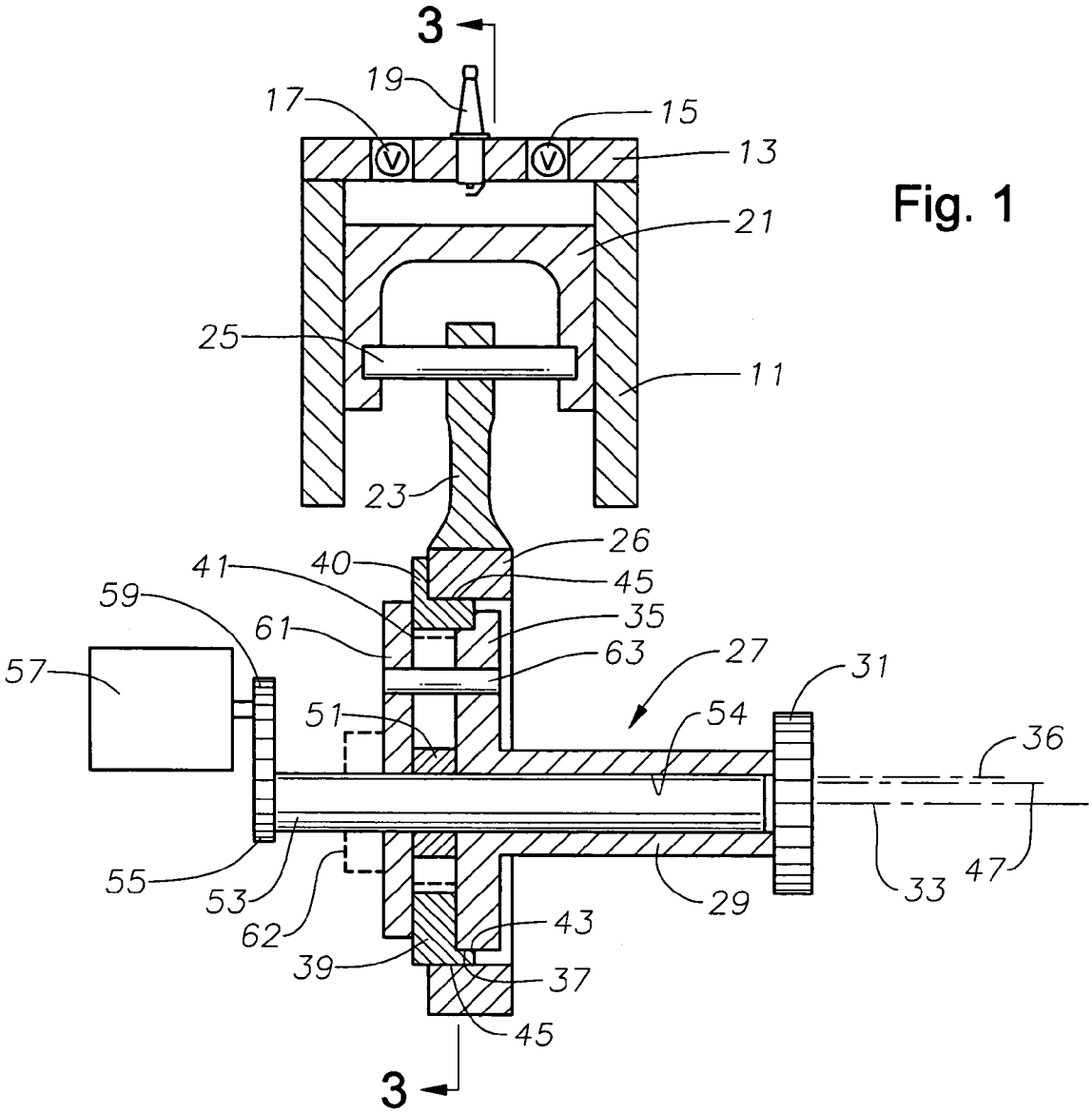
FIG. 1 is a schematic sectional view of a crankshaft, piston and cylinder.

Referring to FIG. 1, a single cylinder 11 is shown, however the engine would typically have a number of cylinders. Cylinder 11 has a head 13 with at least one intake valve 15 and one discharge valve 17. A spark plug 19, shown in head 13, would be used for gasoline engines but not for diesel engines.

A piston 21 reciprocates within cylinder 11. Piston 21 drives a rod 23 that is pivotally secured to it by a pin 25. The lower end of rod 23 is rigidly mounted to a bushing 26. Bushing 26 is a circular ring having concentric inner and outer diameters. Bushing 26 drives a crankshaft assembly 27. Crankshaft assembly 27 has an output shaft 29 delivering power, such as to a transmission. Output shaft 29 is schematically shown having an output gear 31. Output shaft 29 and output gear 31 rotate about a shaft axis 33. For a pump or compressor (not shown), output shaft 29 would be an input shaft.

An eccentric inner crank member 35 is rigidly mounted to output shaft 29 for rotation therewith. Inner crank member 35 has a circular outer diameter, the axis of which is indicated by the numeral 36. Inner crank member axis 36 is offset from output shaft or main drive axis 33. The amount of offset affects the length of the stroke of piston 21. Inner crank member 35 has an outer diameter 37 that is concentric with inner crank member axis 36 and spaced near the outer diameter of inner crank member 35. Inner crank member 35 rotates once about main drive axis 33 for each downward and upward stroke of piston 21. "Downward" refers to away from head 13, and "upward" refers to toward head 13.

Figure 2:
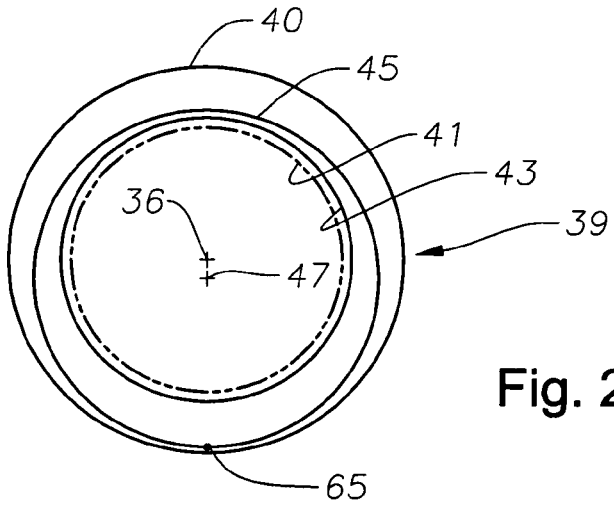
FIG. 2 is a side view of the outer crank member of the crankshaft of FIG. 1.

An outer crank member 39 has an inner diameter portion 43 slidingly mounted on inner crank member outer diameter 37 so that it can rotate relative to inner crank member 35. Referring also to FIG. 2, outer crank member 39 has a smooth cylindrical outer diameter 40 and a set of teeth 41 in its inner diameter 43. Outer crank member outer diameter 40 and the pitch diameter of teeth 41 are concentric with inner crank member axis 36 and offset from output shaft axis 33. Teeth 41 do not extend the full thickness or width of outer crank member 39, from the left to the right side, as shown in FIG. 1. A counterbore portion of inner diameter 43 is located next to and on the right side of teeth 41 as shown in FIG. 1. The counterbore portion is a smooth cylindrical surface of slightly larger diameter than the pitch diameter of teeth 41 for slidingly receive inner crank member outer diameter 37. The pitch diameter of teeth 41 is thus substantially the same as the outer diameter 37 of inner crank member 35 in the preferred embodiment. For clarity, teeth 41 are not shown in FIGS. 3–10.

Outer crank member 39 has eccentric surface 45 that is an offset circular surface sliding in mating contact with the inner diameter of rod bushing 26. Eccentric surface 45 is thus offset relative to the pitch diameter of teeth 41 and outer diameter 40 of outer crank member 39. As shown in FIG. 2, eccentric surface 45 is concentric about an axis 47 that is offset from axis 36 of outer diameter 40 of outer crank member 39. Outer diameter 40 is larger in diameter than the diameter of eccentric surface 45, but because of the offset, a small circumferential portion of eccentric surface 45 is substantially tangent to a small circumferential portion of outer diameter 40 in the preferred embodiment.

An adjustment gear 51 has teeth that mesh with teeth 41 of outer crank member 39. The pitch diameter of outer crank member teeth 41 is a multiple, preferably two times, that of the pitch diameter of adjustment gear 51. Consequently, with adjustment gear 51 held stationary, it takes two full revolutions for outer crank member 39 to rotate around adjustment gear 51. Inner crank member 35 rotates twice during the one revolution of outer crank member 39 and piston 21 makes four strokes. Adjustment gear 51 is rigidly mounted to an adjustment shaft 53 that extends the opposite direction from but coaxial with output shaft 29 in this embodiment. A key (not shown) secures adjustment gear 51 to adjustment shaft 53 for rotation therewith.

Adjustment shaft 53 is closely but rotatably received within a bore 54 of output shaft 29. Adjustment shaft 53 may remain stationary during stroking of piston 21 and rotation of output shaft 29 or alternately, it can be caused to rotate selected incremental amounts while output shaft 29 continues to turn or is stationary. Adjustment shaft 53 is selectively rotated to change the position of eccentric surface 45 relative to the connection point of rod 23 to bushing 26. The change in position varies the length of the stroke of piston 21, as will be subsequently explained.

Various devices may be employed to rotate adjustment shaft 53. The mechanism shown comprises a gear 55 mounted to shaft 53. Gear 55 engages a gear 59 of a stepper motor 57. Stepper motor 57 may be an electrical motor, which when supplied with a control signal, will rotate adjustment shaft 53 in either clockwise or counterclockwise directions. This rotation rotates adjustment gear 51, which in turn drives outer crank member 39, thereby causing the position of outer crank member eccentric surface 45 to rotate relative to the position of piston 21.

A support plate 61 is mounted to the opposite side of outer crank member 39 from inner crank member 35. At least one fastener 63 secures support plate 61 to inner crank member 35 so that support plate 61 rotates with inner crank member 35. Support plate 61 has an offset hole through which adjustment shaft 53 passes and is employed to retain outer crank member 45 with inner crank member 35. Rotating adjustment shaft 53 does not cause support plate 61 to rotate. Other types of retainers may be employed, as well.

An optional locking device 62, such as a clutch, may be mounted to adjustment shaft 53. When actuated, locking device 62 causes adjustment shaft 53 to rotate in unison with output shaft 29. Outer crank member 39 in that instance would rotate in unison with inner crank member 35.

FIGS. 3–10 are schematic sectional views of bushing 26 and outer crank member 39 during stroking of piston 21. FIGS. 3–6 show four strokes of piston 21 with outer crank member eccentric surface 45 in one position relative to piston 21. FIGS. 7–10 show four stroke of piston 21 with outer crank member eccentric surface 45 adjusted 90 degrees from the position of FIGS. 3–6. Reference point 65 shown in FIGS. 3–10 refers to the point on outer crank member eccentric surface 45 that is the farthest from outer crank member teeth 41. When adjustment gear 51 is stationary and piston 21 strokes, outer crank member 39 will orbit or revolve around adjustment gear 51 as can be seen by comparing FIGS. 3–6. Outer crank member 39 has no fixed center point about which it rotates, thus it is considered to orbit. The sliding engagement between outer crank member 39 and inner crank member 35 causes inner crank member 35 to rotate about shaft axis 33, causing shaft 29 (FIG. 1) to rotate. In the position of FIGS. 3–6, adjustment gear 51 is stationary at a point that positions reference point 65 at top dead center while piston 21 is also at top dead center.

Figure 3:
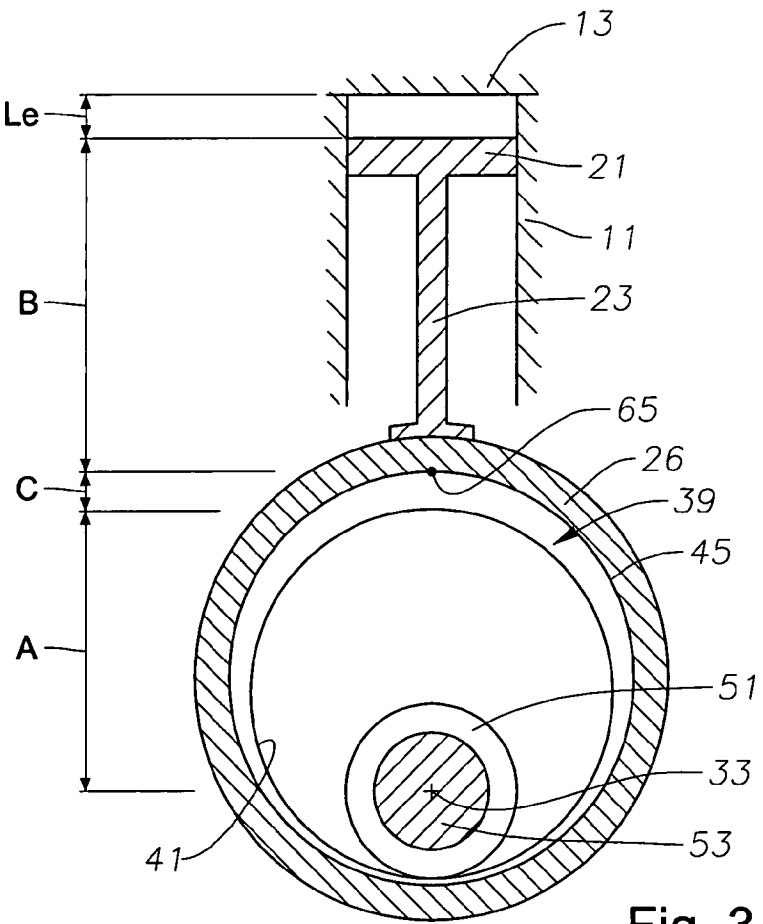
FIG. 3 is a schematic sectional view of the crankshaft of FIG. 1, taken along the line 3—3 of FIG. 1 and showing the piston at the top of an exhaust stroke.

The position of piston 21 in FIG. 3 is referred to herein as the top of the exhaust stroke, but it need not be an exhaust stroke. In this position, exhaust would have been expelled through valve 17 (FIG. 1) during the movement of piston 21 to the position in FIG. 3. The distance Le is distance from the top of piston 21 to head 13 at the top of the exhaust stroke. Distance B is a fixed distance from the inner diameter of bushing 26 to the top of piston 21. Distance C (FIG. 3) is a fixed distance from reference point 65 to the pitch diameter of outer crank member teeth 41, which by definition herein, is the maximum distance from any part of the outer diameter of eccentric 45 to the pitch diameter of outer crank member teeth 41. Distance A is the distance from output shaft axis 33 to the pitch diameter of outer crank member teeth 41 while piston 21 is at top dead center. The top of piston 21 is a distance from output shaft axis 31 equal to A plus B plus C.

Figure 4:
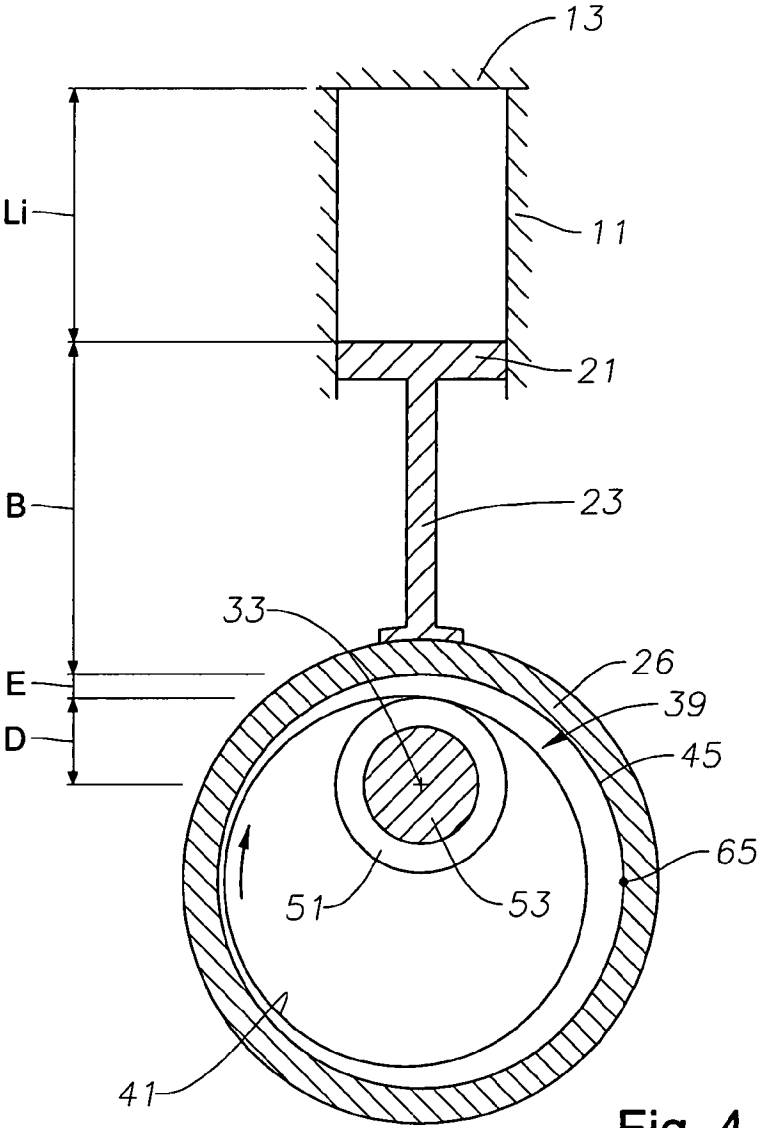
FIG. 4 is a view similar to FIG. 3, but showing the piston at the bottom of an intake stroke.

The rotational momentum of the drive train on the output shaft 29 (FIG. 1) causes piston 21 to stroke downward to the position shown in FIG. 4, which is referred to herein as an intake stroke. During this stroke, piston 21 will be drawing an atomized mixture of fuel and air into the chamber through intake valve 15 (FIG. 1). The dimension Li represents the distance between the top of piston 21 and head 13 while piston 21 is at bottom dead center. Note that between the position of FIGS. 3 and 4, adjustment gear 51 has not rotated, rather outer crank member 39 (FIG. 1) has rotated 90°. Because of the two to one ratio between gear teeth 41 and adjustment gear 51, outer crank member 39 rotates only 90 degrees while inner crank member 35 (FIG. 1) will have rotated 180 degrees. The orbiting movement of outer crank member 39 causes inner crank member 35 to rotate about shaft axis 33 (FIG. 1). Adjustment gear 51 is 180 degrees from the position in FIG. 3 because it's a drive shaft 53 follows the path of revolution of inner crank member 35. Reference point 65 is now in a 90° position.

Figure 5:
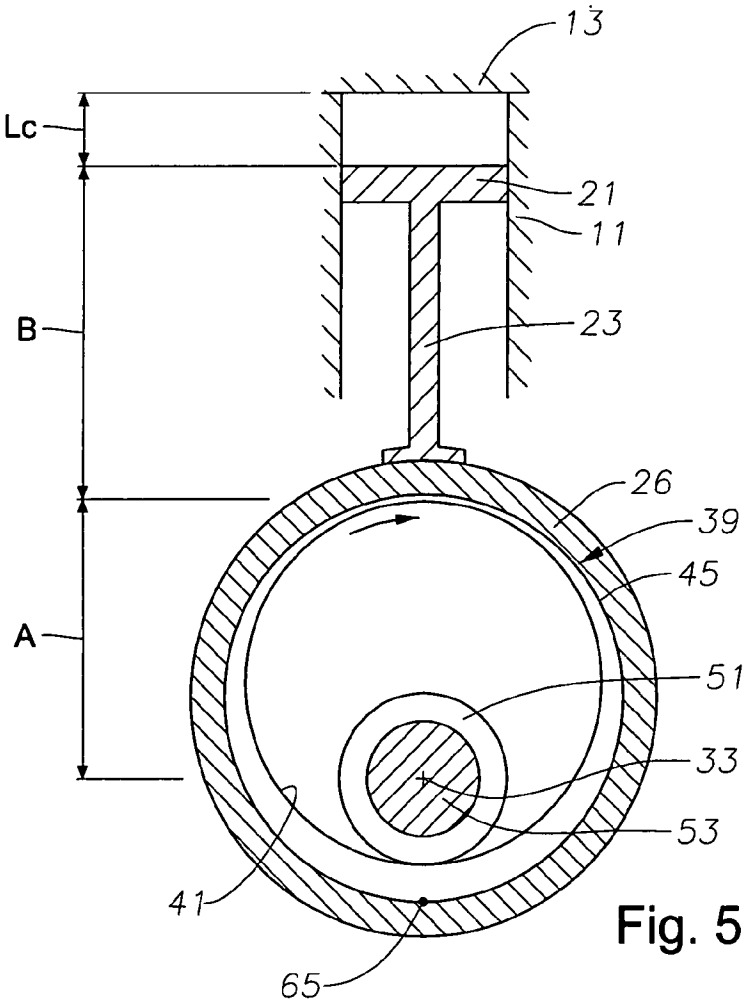
FIG. 5 is a view similar to FIG. 4, but showing the piston at the top of a compression stroke.

Referring to FIG. 5, piston 21 now strokes back upward due to the momentum of output shaft 29 (FIG. 1), this being a compression stroke. Valves 15, 17 are closed during this stroke, and if the engine is a gasoline engine, spark plug 19 would fire when piston 21 is in the position of FIG. 5. From the position of FIG. 4 to FIG. 5, outer crank member 39 moves another 90° as indicated by the reference point 65. Inner crank member 35 (FIG. 1) will also rotate about shaft axis 33, causing shaft 29 to rotate (FIG. 1). Adjustment gear 51 continues to remain stationary in this example. The dimension Lc represents the amount of space between the top of piston 21 and head 13 while at the top of the compression stroke.

Note that the distance Lc is not the same as the distance Le in the particular adjustment shown in FIGS. 3–6, even though in both positions, outer crank member 39 is engaging adjustment gear 51 at a 180 degree position. Adjustment gear 51 has remained stationary. The difference is due to the location of reference point 65 in FIG. 5 being at 180 degrees while in FIG. 3, reference point 65 is at zero degrees. The difference between dimensions Le and Lc is proportional to the radial distance C (FIG. 3) from reference point 65 to the pitch diameter of outer crank member teeth 41. In FIG. 3, piston 21 rises to a point based on dimension A, which is from output shaft axis 33 to the inner diameter of outer crank member 39 while piston 21 is at top dead center, plus distance B, which is the distance from the inner diameter of bushing 26 to the top of piston 21, plus dimension C. In FIGS. 3 and 5, distance A and B are the same, but distance C does not add to the stroke in FIG. 5, because reference point 65 is located at 180 degrees.

Figure 6:
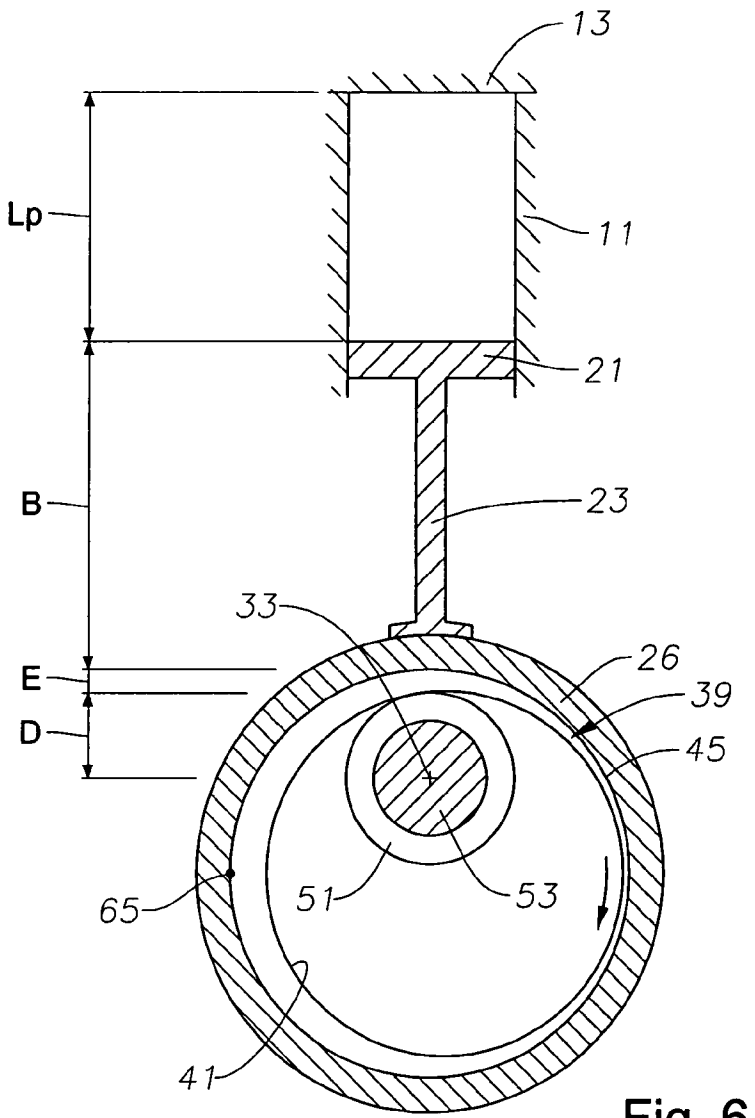
FIG. 6 is a view similar to FIG. 5, but showing the piston at the bottom of a power stroke.

In FIG. 6, a power stroke has occurred with the dimension Lp being the distance from the top of piston 21 to head 13 while piston 21 is at the bottom of the stroke. The dimensions Lp and Li (FIG. 4) are the same because reference point 65 has moved to the 270° position in FIG. 6 and was in the 90 degree position in FIG. 4. In both cases, the distance from eccentric outer diameter surface 45 to the inner diameter of outer crank member 39 added the same amount to the stroke. Distance B is fixed and is the same as in FIGS. 3 and 5. Distance D, which is the distance from output shaft axis 33 to the inner diameter of bushing 26 while piston 21 is at bottom dead center, is the same in FIGS. 4 and 6. The radial dimension E, which is the distance from outer crank member pitch diameter 41 to eccentric outer diameter surface 45 while piston 21 is at the bottom of the stroke and eccentric reference point 65 is either at the 90 degree or 270 degree position, is the same in FIGS. 4 and 6. The assembly as shown in FIGS. 3–6 has a compression ratio that is Li over Lc FIG. 7 shows the assembly again at the top of the exhaust stroke as in FIG. 3. However, stepper motor 57 has rotated adjustment shaft 53 180 degrees, which changes the position of outer crank member eccentric 45 relative to piston 21. Reference point 65 is now at a 90° position when piston 21 is at top dead center. The distance from output shaft axis 33 to the top of piston 21 is the sum of lengths A plus B plus E. Length E is the distance from the pitch diameter 41 of outer crank member 39 to the inner diameter of bushing 26 at the zero degree position, and in this example, it is the same as in FIGS. 4 and 6. Distance E is less than distance C of FIG. 3, consequently, Le' will be larger than Le of FIG. 3.

Figure 8:
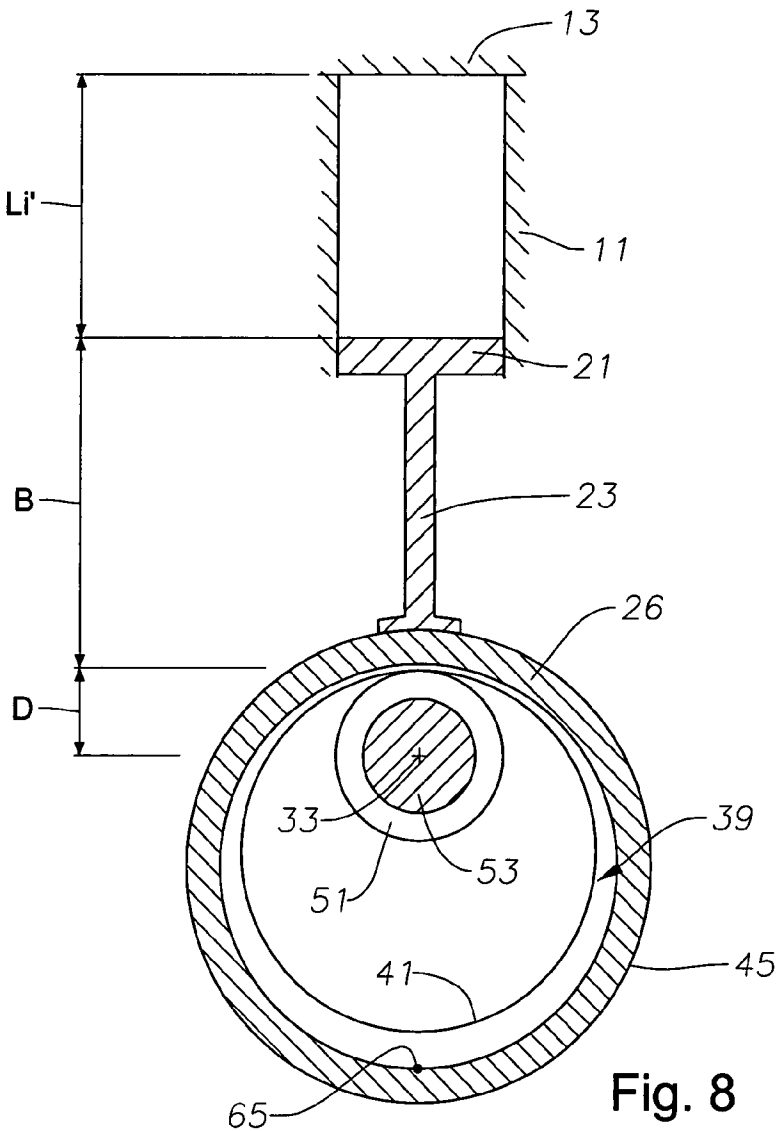
FIG. 8 is a view similar to FIG. 7, but showing the piston at the bottom of the intake stroke.
Figure 7:
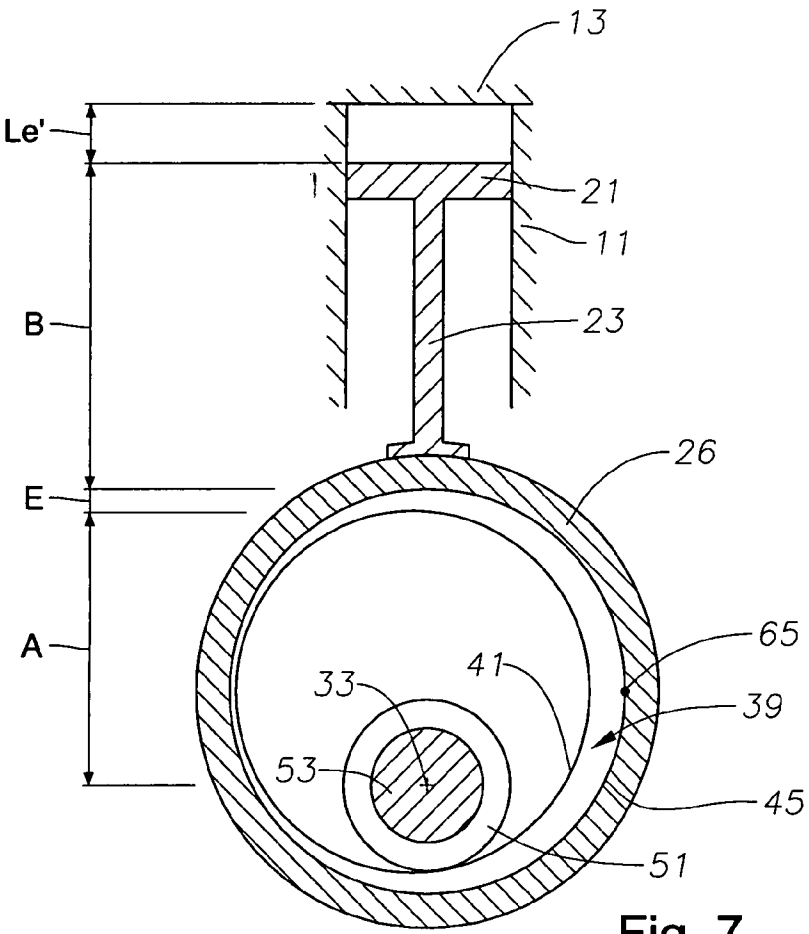
FIG. 7 is a view similar to FIG. 3, but showing the outer crank member rotated relative to the piston to a position 90° from the position shown in FIG. 3, and showing the piston at the top of the exhaust stroke.

FIG. 8 compares to FIG. 4, with piston 21 now at the bottom of the intake stroke. Reference point 65 is now at the 180° position. The distance from output shaft axis 33 to the top of piston 21 is the sum of lengths D and B. Because there is no length E to add, as in FIG. 4, Li' is thus greater than Li of FIG. 4. Li' is greater because the point where eccentric surface 45 is closest to outer crank member teeth 41 is now located on the upper side of adjustment gear 51.

Figure 9:
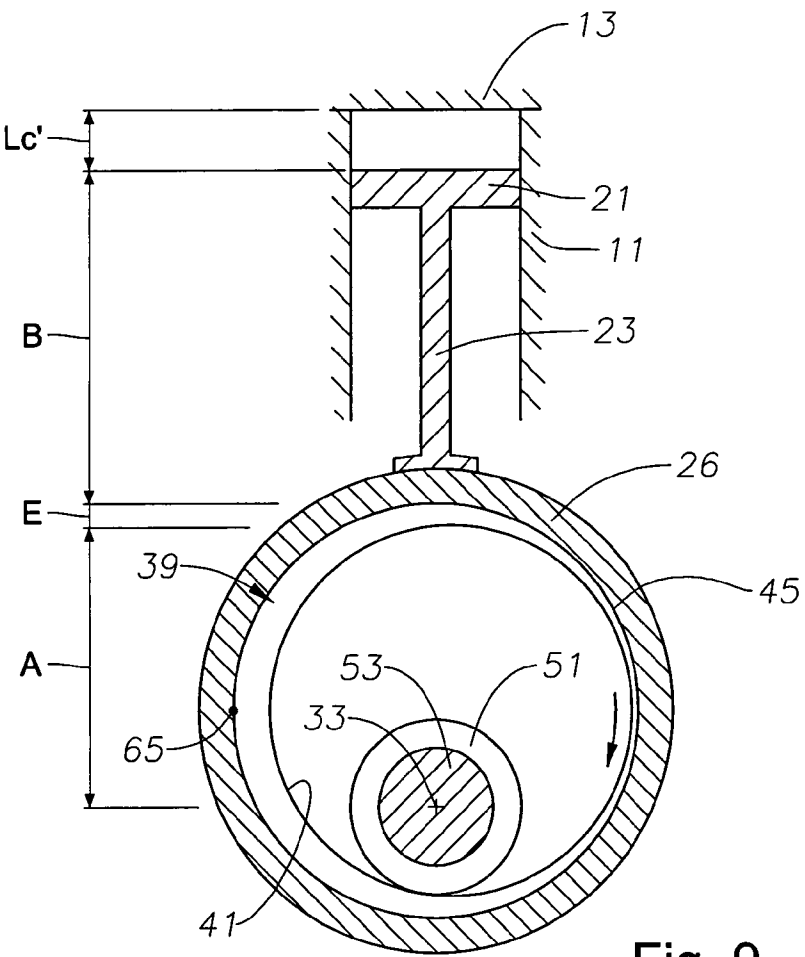
FIG. 9 is a view similar to FIG. 7, but showing the piston at the top of the compression stroke.

As the piston then moves to the compression stroke in FIG. 9, reference point 65 moves to the 270° position. The distance to the top of piston 21 is the sum of lengths A plus B plus E. Because in FIG. 5 there was no dimension E add, this results in Lc' being smaller Lc. The length of the compression stroke in FIG. 9, which is the distance that piston 21 traveled from FIG. 8 to FIG. 9, is length A plus length E minus length D. The length of the compression stroke in FIG. 5, which is the distance piston 21 traveled from FIG. 4 to FIG. 5, is length A minus length D plus E. Thus the compression stroke length in FIG. 9 is greater than the compression stroke length in FIG. 5 by the dimension two times E. The dimension Li in FIG. 4 is greater than the dimension Li' in FIG. 8 by the distance E. The dimension Lc in FIG. 5 is greater than the dimension Lc' in FIG. 9 by the increment E. Consequently, the compression ratio Li'/Lc' is greater than the compression ratio Li/Lc. The adjustment in FIGS. 7–10 thus increased the compression ratio.

Figure 10:
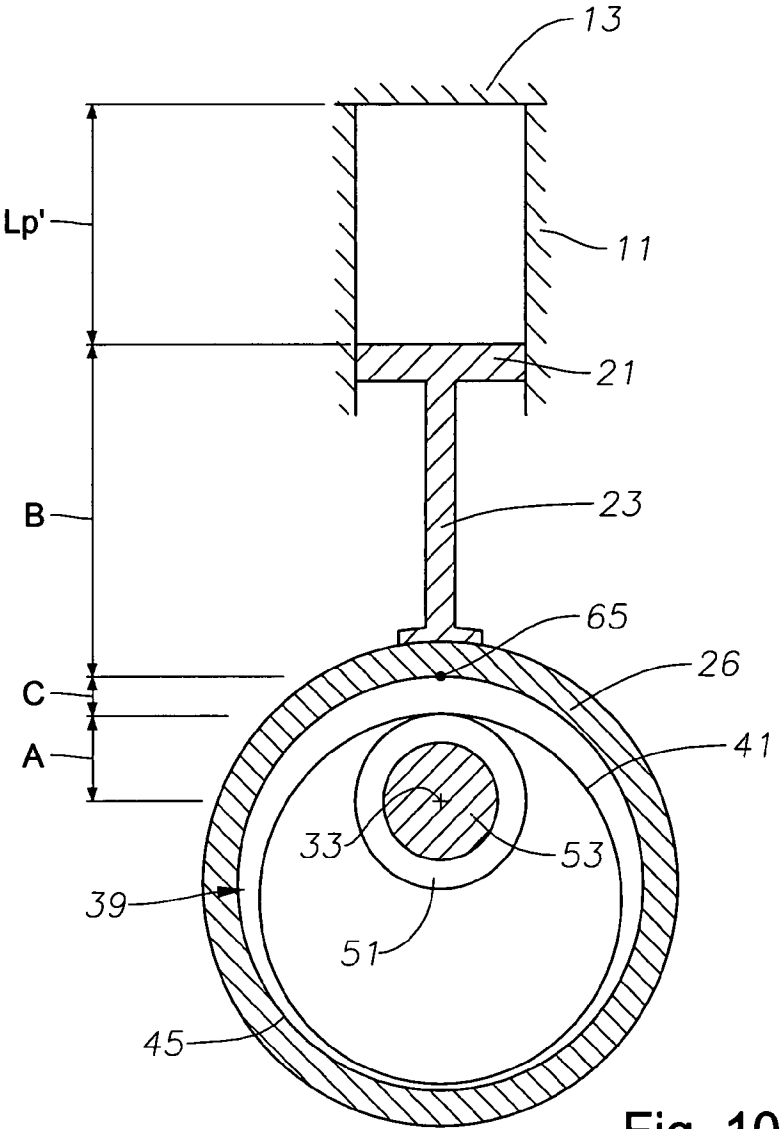
FIG. 10 is a view similar to FIG. 7, but showing the piston at the bottom of the power stroke.

FIG. 10 shows the power stroke with reference point 65 now being at the 0° position. The distance from output shaft axis 33 to the top of piston 21 is the sum of lengths D, C and B. In FIG. 6, the distance from output shaft axis 33 to piston 21 is the sum of lengths D, E and B. Because length C is greater than length E, however, the power stroke dimension Lp' shown in FIG. 10 is less than the power stroke dimension Lp of FIG. 6.

Adjustment shaft 53 can rotate eccentric 45 to change the position of eccentric reference point 65 from zero degrees as shown in FIG. 3 to any degree relative to piston 21 while piston 21 is at top dead center. The lengths of the strokes and the various distances to head 13 will change depending upon the adjustment selected. Stepper motor 57 may be connected to a computer that senses a variety of conditions of the engine and the atmosphere, and incrementally rotates adjustment shaft 53 in response. The distance of piston 21 to head 13 during the various strokes and the compression ratio can be changed readily for the different conditions. Stepper motor 57 will make these adjustments while the engine is running.

In the preferred embodiment described, inner crank member 35 makes two 360 degree rotations and piston makes two upward strokes and two downward strokes for each 360 degree rotation of outer crank member 39. Adjusting reference point 65 results in the ability to make the two upward strokes differ in length from each other and the two downward strokes differ in length from each other for each full revolution of outer crank member 39. Consequently, for a four cycle engine, the exhaust stroke can differ from the compression stroke. In FIGS. 3–6, distance Le for the exhaust stroke differs from distance Lp for the power stroke and intake stroke Li equals power stroke Lp even though adjustment gear 51 remains stationary during the full four cycles. In FIGS. 7–10, the new position of reference point 65 causes the intake stroke Li' to differ from the power stroke Lp' while the exhaust stroke Le' and compression stroke lc' are the same. Many variations are possible, including making all of the stroke lengths differ, depending upon the location of reference point 65.

As mentioned above, if desired, clutch 62 (FIG. 1) will lock adjustment shaft 53 to output shaft 29 with eccentric reference point 65 in a desired orientation. If so, outer crank member 39 would no longer rotate relative to inner crank member 35, rather would rotate in unison about drive shaft axis 31 during the piston strokes. A single downward and single upward stroke of piston 21 would cause outer crank member 39 and inner crank member 35 to rotate 360 degrees about drive shaft axis 31. Each downward and each upward stroke would be identical. The selected orientation of reference point 65 when clutch 62 is actuated determines the stroke length of piston 21 and thus the displacement of the engine.

Although shown in connection with an internal combustion engine, the principles of this invention also apply to pumps and compressors. The stroke length can be made to decrease by the adjustment shaft as the load increases. Further, although a gear ratio of two to one is preferred, higher ratios could be used, which would cause more than four strokes of the piston to revolve the outer crank member a single time.

While the invention has been shown in only one of its forms, it should be apparent to those skilled in the art that it is not so limited but is susceptible to various changes without departing from the scope of the invention.

What is claimed is:

1. A drive apparatus, comprising:

a piston slidably carried in a cylinder for stroking reciprocally in the cylinder;

a piston rod having a first end connected to the piston and a second end with a circular bushing;

an outer crank member having a circular bushing surface that slidably engages the bushing, and a circular inner crank portion that is eccentric to the circular bushing;

an inner crank member having a circular portion in sliding engagement with the inner crank portion, the inner crank member being rotatable about a main drive axis that is eccentric relative to the inner and outer crank members, such that a single downward and a single upward stroke of the piston causes one revolution of the inner crank member about the main drive axis;

a set of circular gear teeth on the outer crank member;

an adjustment gear in engagement with the gear teeth of the outer crank member, the gear teeth having a ratio relative to the adjustment gear so that the outer crank member revolves once about the adjustment gear while the adjustment gear is stationary while the piston strokes at least downward twice and upward twice, the adjustment gear being selectively rotatable to cause the outer crank member to rotate to a different position relative to the inner crank member to vary the stroke of the piston; and wherein the gear teeth are located on an inner diameter portion of the outer crank member.

2. The drive apparatus according to claim 1, wherein the adjustment gear has a stationary position in which for each four stoke cycle, a first upward stroke of the piston differs in length from a second upward stroke of the piston.

3. The drive apparatus according to claim 1, wherein rotating the adjustment gear while the outer crank member is stationary changes a distance from the piston to the main drive axis.

4. The drive apparatus according to claim 1, wherein while the piston is in a top dead center position, the inner crank member is at a maximum eccentric position, and wherein a radial dimension of the outer crank member from the bushing to the inner crank member while the piston is in the top dead center position depends upon the rotational orientation of the outer crank member relative to the inner crank member.

5. The drive apparatus according to claim 1, wherein the adjustment gear is located on an axis concentric with the main drive axis.

6. The drive apparatus according to claim 1, wherein the bushing surface is located on an outer diameter portion of the outer crank member and the inner crank member engages an inner diameter portion of the outer crank member.

7. A drive apparatus, comprising:

a piston slidably carried in a cylinder for stroking reciprocally in the cylinder;

a piston rod having a first end connected to the piston and a second end with a circular bushing;

an outer crank member having a circular bushing surface that slidably engages the bushing, and a circular inner crank portion that is eccentric to the circular bushing;

an inner crank member having a circular portion in sliding engagement with the inner crank portion, the inner crank member being rotatable about a main drive axis that is eccentric relative to the inner and outer crank members, such that a single downward and a single upward stroke of the piston causes one revolution of the inner crank member about the main drive axis;

a set of circular gear teeth on the outer crank member;

an adjustment gear in engagement with the gear teeth of the outer crank member, the gear teeth having a ratio relative to the adjustment gear so that the outer crank member revolves once about the adjustment gear while the adjustment gear is stationary while the piston strokes at least downward twice and upward twice, the adjustment gear being selectively rotatable to cause the outer crank member to rotate to a different position relative to the inner crank member to vary the stroke of the piston; and a locking device for selectively locking the outer crank member and inner crank member for rotation in unison.

8. A drive apparatus, comprising:

a piston slidably carried in a cylinder for stroking reciprocally in the cylinder;

a piston rod having a first end connected to the piston and a circular bushing on a second end;

a outer crank member having a circular bushing surface that slidably receives the bushing and a circular crank surface eccentrically offset from the bushing surface;

an inner crank member having a circular surface in slidable engagement with the crank surface of the outer crank member, the inner crank member being rotatable about a main drive axis that is eccentric relative to the inner crank member;

a rotatable drive member in engagement with the inner crank member for rotating about the main drive axis;

a circular set of gear teeth on the outer crank member eccentrically offset from the crank bushing surface;

an adjustment gear in engagement with the gear teeth so that the outer crank member revolves about the adjustment gear while the adjustment gear is stationary; and an adjustment device coupled to the adjustment gear for selectively rotating the adjustment gear to cause the outer crank member to rotate relative to the inner crank member to vary the distance between the piston and the drive axis at a selected piston position.

9. The drive apparatus according to claim 8, wherein:

a gear tooth ratio of the adjustment gear and the outer crank member is two to one so as to cause the piston to make two downward strokes and two upward strokes for each revolution of the outer crank member; and two downward strokes and two upward strokes of the piston causes the inner crank member to rotate two revolutions.

10. The drive apparatus according to claim 8, further comprising a gear shaft on which the adjustment gear is mounted for rotation therewith; and wherein the gear shaft is driven by the adjustment device.

11. The drive apparatus according to claim 8, wherein the adjustment gear is located on an axis concentric with the main drive axis.

12. The drive apparatus according to claim 8, wherein the rotatable drive member comprises a hollow drive shaft mounted to the inner crank member for rotation therewith; and the apparatus further comprises:

a gear shaft that extends through the adjustment gear and into the hollow drive shaft; and wherein the adjustment gear is mounted to the gear shaft for rotation therewith; and the adjustment device selectively rotates the gear shaft.

13. The drive apparatus according to claim 8, wherein the bushing surface is located on an outer diameter portion of the outer crank member and the crank surface is located on an inner diameter portion of the outer crank member.

14. The drive apparatus according to claim 8, wherein the gear teeth are located on an inner diameter portion of the outer crank member.

15. The drive apparatus according to claim 8 wherein the cylinder comprises an internal combustion chamber of an engine.

16. A drive apparatus, comprising:

a piston slidably carried in a cylinder for stroking reciprocally in the cylinder;

a piston rod having a first end connected to the piston and a circular bushing on a second end;

a outer crank member having an outer diameter portion with a circular bushing surface that slidably receives the bushing and a first inner diameter portion with a circular crank surface, the crank surface having a center eccentric to a center of the bushing surface;

an inner crank member having an outer diameter portion in slidable engagement with the crank surface of the outer crank member, the inner crank member being rotatable about a main drive axis that is eccentric relative to the a center of the outer diameter portion of the inner crank member, the inner crank member rotating one revolution for each downward and upward stroke of the piston;

a rotatable drive member in engagement with the inner crank member for rotating about the main drive axis;

a set of gear teeth on a second inner diameter portion of the outer crank member eccentrically offset from the crank bushing surface;

an adjustment gear in engagement with the gear teeth and mounted on a gear shaft that is coaxial with the main drive axis, the gear teeth over the adjustment gear having a ratio of two to one, causing the piston to stroke twice downward and twice upward for each revolution of the outer crank member revolving about the adjustment gear while the adjustment gear is stationary; and an adjustment device coupled to the gear shaft for selectively rotating the adjustment gear to cause the outer crank member to rotate to a different position relative to the position of the piston.

17. The drive apparatus according to claim 16, wherein the adjustment gear has a selected stationary position that causes a first upward stroke of the piston to differ in length from a second upward stroke of the piston for each revolution of the outer crank member.

18. The drive apparatus according to claim 16, wherein the adjustment gear has a selected stationary position that causes a first downward stroke of the piston to differ in length from a second downward stroke of the piston for each revolution of the outer crank member.

19. The drive apparatus according to claim 16 wherein the cylinder comprises an internal combustion chamber of an engine.

* * * * *